US008740023B2

(12) United States Patent
Geiger et al.

(10) Patent No.: US 8,740,023 B2
(45) Date of Patent: Jun. 3, 2014

(54) ONE-WAY VALVE FOR DISCHARGE REGULATION IN TUBES, TUBE WITH SUCH A ONE-WAY VALVE AND METHOD FOR MANUFACTURING SUCH A ONE-WAY VALVE

(75) Inventors: Andreas Geiger, Steffisburg (CH); Christian Kubesch, Oberdiessbach (CH); Mario Schüpbach, Konolfingen (CH)

(73) Assignee: Hoffmann Neopac AG (CH)

( * ) Notice: Subject to any disclaimer, the term of this patent is extended or adjusted under 35 U.S.C. 154(b) by 13 days.

(21) Appl. No.: 13/578,401

(22) PCT Filed: Apr. 12, 2010

(86) PCT No.: PCT/CH2010/000096

§ 371 (c)(1),
(2), (4) Date: Aug. 10, 2012

(87) PCT Pub. No.: WO2011/127610

PCT Pub. Date: Oct. 20, 2011

(65) Prior Publication Data

US 2012/0305607 A1 Dec. 6, 2012

(51) Int. Cl.
*B65D 5/72* (2006.01)

(52) U.S. Cl.
USPC ..... 222/494; 222/92; 222/213; 222/422

(58) Field of Classification Search
USPC ..... 222/212–215, 92, 491, 494, 570, 420, 222/422; 137/854; 215/11.4, 311, 363; 604/298, 295; 425/52–53; 264/328.8, 264/255, 259, 264, 271.1, 279, 328.7, 264/328.14, 328.16
See application file for complete search history.

(56) References Cited

U.S. PATENT DOCUMENTS 2,957,501 A * 10/1960 Holmes ..... 141/2
3,456,650 A * 7/1969 Schwartzman ..... 604/298

(Continued)

FOREIGN PATENT DOCUMENTS

DE 102 13 124 10/2003
EP 0 624 526 11/1994

(Continued)

OTHER PUBLICATIONS

EP1504731, Machine Translation.*

(Continued)

*Primary Examiner* — Paul R Durand
*Assistant Examiner* — Randall Gruby
(74) *Attorney, Agent, or Firm* — Ostrolenk Faber LLP

(57) ABSTRACT

The invention relates to a one-way valve (1; 1') for discharge regulation of a tube, the one-way valve (1; 1') comprising a sealing means (9) and a ring support (8), with the sealing means (9) being at least partially inserted in the ring support (8), wherein the sealing means (9) comprises a sealing element (11) and a support element (12) that has at least one opening (10), wherein the sealing element (11) is connected to the support element (12) by anchoring means (13) and rests on the ring support (12) in a closed state of the one-way valve (1; 1') thereby covering the at least one opening (10), and wherein the sealing element (11) is of lower bending stiffness than the support element (12) and the ring support (8). The invention furthermore relates to a tube with a tube head (2; 2') and a container (6), wherein such a one-way valve (1; 1') is inserted in the neck (4) of the tube head (2; 2'). Moreover the invention relates to a method for manufacturing such a one-way valve (1; 1').

7 Claims, 7 Drawing Sheets

(56) References Cited

U.S. PATENT DOCUMENTS

| | | | | | |
|---|---|---|---|---|---|
| 3,568,977 | A * | 3/1971 | Nelson | 251/148 |
| 3,592,245 | A * | 7/1971 | Schneller et al. | 141/25 |
| 4,154,371 | A * | 5/1979 | Kolaczinski et al. | 222/212 |
| 4,430,285 | A * | 2/1984 | Runyan et al. | 264/242 |
| 4,459,256 | A * | 7/1984 | Ziegler | 264/152 |
| 4,493,444 | A * | 1/1985 | Del Bon et al. | 222/402.22 |
| 4,524,880 | A * | 6/1985 | Danielson et al. | 220/288 |
| 4,672,996 | A * | 6/1987 | Floyd et al. | 137/522 |
| 4,758,224 | A * | 7/1988 | Siposs | 604/119 |
| 4,771,925 | A * | 9/1988 | Stoffler et al. | 222/207 |
| 4,986,322 | A * | 1/1991 | Chibret et al. | 141/319 |
| 5,173,033 | A * | 12/1992 | Adahan | 417/234 |
| 5,275,312 | A * | 1/1994 | Labruzzo | 222/212 |
| 5,304,336 | A * | 4/1994 | Karlsson et al. | 264/242 |
| 5,421,718 | A * | 6/1995 | Karlsson et al. | 425/577 |
| 5,687,882 | A * | 11/1997 | Mueller | 222/212 |
| 5,788,215 | A * | 8/1998 | Ryan | 251/149.6 |
| 6,644,510 | B2 * | 11/2003 | Kawolics et al. | 222/105 |
| 6,766,915 | B2 * | 7/2004 | Wu | 215/11.4 |
| 6,832,479 | B2 * | 12/2004 | Nakagawa et al. | 60/589 |
| 6,889,707 | B2 * | 5/2005 | Nicolino | 137/513.5 |
| 7,082,967 | B2 * | 8/2006 | Sarajian et al. | 137/854 |
| 7,222,751 | B2 | 5/2007 | Kerman et al. | 222/92 |
| 2004/0007601 | A1 * | 1/2004 | Masuda | 222/494 |
| 2004/0050872 | A1 * | 3/2004 | Masuda | 222/212 |
| 2006/0138697 | A1 * | 6/2006 | Lorenz et al. | 264/242 |
| 2008/0314933 | A1 * | 12/2008 | Leonoff | 222/215 |
| 2010/0314393 | A1 * | 12/2010 | Streuer | 220/360 |
| 2012/0116217 | A1 * | 5/2012 | Lee-Sepsick et al. | 600/432 |

FOREIGN PATENT DOCUMENTS

| | | | |
|---|---|---|---|
| EP | 1504731 | * | 2/2005 |
| JP | 2004-034996 | | 2/2004 |
| WO | WO 99/12821 | | 3/1999 |
| WO | 2009/077023 | * | 6/2009 |

OTHER PUBLICATIONS

WO2009077023, Machine Translation.*

WO 2008003279—English Machine Translation, RIBARC, Oct. 1, 2008.*

International Search Report mailed Jul. 13, 2010 in corresponding PCT International Application No. PCT/CH2010/000096.

* cited by examiner

ONE-WAY VALVE FOR DISCHARGE REGULATION IN TUBES, TUBE WITH SUCH A ONE-WAY VALVE AND METHOD FOR MANUFACTURING SUCH A ONE-WAY VALVE

CROSS-REFERENCE TO RELATED APPLICATION

The present application is a 35 U.S.C. §§371 national phase conversion of PCT/CH2010/000096, filed Apr. 12, 2010, the content of which is incorporated herein by reference. The PCT International Application was published in the English language.

TECHNICAL FIELD

The invention relates to a one-way valve for discharge regulation in tubes, a tube with such a one-way valve and a method for manufacturing such a one-way valve according to the preambles of the independent claims.

BACKGROUND

After dispensing of some of their contents plastic tubes usually tend to suck in ambient air due to recovery of the tube container which causes a negative pressure inside the tube. The ambient air can react with the contents of the tube container, in particular if the contents are oxygen-sensitive. The fill level of the tube can typically not be inspected visually, as the tube container retakes its original shape due to the sucked in ambient air.

Furthermore, dispensing very liquid contents as drops from known tubes is often not possible as the potentially high internal pressure can lead to the drops being dispensed too fast or in form of a jet.

Japanese patent application JP 2004-034996 A discloses a tube with a tube container, a tubular mouth and a cap member. When the cap member is mounted on the tubular mouth such that an internal space of the tubular mouth is hermetically sealed, a vent passage is formed inside the cap member and around the outer periphery of the tubular mouth, respectively. When the cap member is removed, the internal space of the tubular mouth can communicate with the ambient air via the vent passage such that the contents of the tube container are not accidentally sucked out due to negative pressure.

From the German patent application DE 102 13 124 A1 there is known a valve for automatically closing a tube. The valve has radial slots on the inside and on the outside at a lower level. Radially outwardly projecting stars are formed at an upper level of the valve. For mounting in a tube mouth the valve is turned inside out. The radial slots then serve as anchoring means for fastening the valve at the lower end of the tube mouth. The stars are now inwardly projecting and form a sealing rosette-shaped valve. For fixating the rosette-shaped valve a clamping collar is employed.

Patent document U.S. Pat. No. 7,222,751 B2 relates to collapsible tubes for storing and distributing liquid to pasty products keeping them protected from ambient air. A tube head is disclosed that is fitted with a non-return valve to prevent pollution from ambient air due to relaxation of the pressure on the skirt. The valve is inserted in the neck of the tube head. The valve comprises a sealing means that is in contact with a ring support having an opening. The sealing means is connected to an elastically deformable support element. The sealing means closes the opening when the tube is not compressed. When pressure is applied to the skirt of the tube, the product applies pressure on the sealing means and the sealing means is lifted. When the pressure is removed, the elastic return of the skirt causes a negative pressure that pushes the sealing means into contact with the ring support thereby closing the opening.

Known valves by which the entrance of ambient air into the tube container can be prevented after contents have been dispensed usually require a lot of space inside the tube neck. The known valves often consist of two parts and their sealing area is not adjustable so that the known valves often suffer from insufficient sealing properties. The known valves usually have to be mounted separately which leads to additional and often high costs.

DISCLOSURE OF THE INVENTION

It is an object of the invention to provide a one-way valve that requires little available space and that can be easily mounted. It is a further object of the invention to provide a tube with such a one-way valve and a method for manufacturing such a one-way valve.

In order to implement these and still further objects of the invention, which will become more readily apparent as the description proceeds, a one-way valve for discharge regulation of a tube is provided. The one-way valve comprises a sealing means and a ring support. The sealing means is at least partially inserted in the ring support. The sealing means comprises a sealing element and a support element wherein the sealing element is connected with the support element by anchoring means. The support element has at least one opening. The support element and the ring support are connected to each other and are preferably formed in one piece, i.e. formed integrally, most preferably molded integrally. The anchoring means can be formed by the sealing element and/or the support element. The sealing element is of lower bending stiffness than the support element and the ring support. In particular, the sealing element consists of a soft component and the support element and the ring support consist of a hard component.

The soft component is preferably given by a thermoplastic elastomer (TPE), in particular by a thermoplastic elastomer with a Shore hardness of about 40 Shore A. Preferentially a thermoplastic elastomer based on a styrene-ethylene-butylene-styrene (SEBS) block copolymer is used as soft component. The hard component is preferably given by a thermoplastic polymer, in particular by a polypropylene (PP) with preferentially a Shore hardness of about 70 Shore D. Preferably a polypropylene copolymer is used as hard component.

The sealing element rests on the ring support in a closed state of the one-way valve, thereby closing the at least one opening of the support element. In an open state of the one-way valve the sealing element is lifted off the ring support and at least partly off the support element, thereby uncovering the at least one opening. The sealing element is preferably shaped like a disc or has at least a disc-shaped part. The ring support and the support element form the body or casing of the one-way valve with the sealing element functioning as membrane.

Furthermore, a tube with a tube head and a container is provided. The tube head comprises a port, a hollow neck and a shoulder, wherein the port is connected with the shoulder via the neck and the shoulder is connected to the container. The tube comprises a one-way valve according to the invention that is inserted in the neck of the tube head. The ring support of the one-way valve is sealingly fixed to the neck. The outer surface of the ring support is thereby attached in such a manner to the inner surface of the neck that contents can not pass between them. In particular, the ring support is fixed to the neck by force fitting (also referred to as press fit or interference fit). The sealing element and the ring support of the one-way valve are designed such that the sealing element rests on the ring support when the tube is not compressed and that the sealing element is lifted off the ring support and at least partly off the support element when the tube is compressed thereby changing the state of the one-way valve to an open state, uncovering the at least one opening of the support element. That is, the bending stiffness of the sealing element and the bending stiffness of the ring support and the support element are thus that the bending stiffness of the sealing element is sufficiently low in comparison to the bending stiffness of the ring support and of the support element so that the sealing element is lifted off the ring support and at least partly of the support element when the tube is compressed.

Furthermore, a method for manufacturing a one-way valve according to the invention is provided. The one-way valve is manufactured by two-component injection moulding with the two components being a hard component for forming the ring support and the support element of the one-way valve and a soft component for forming the sealing element of the one-way valve, wherein the ring support and the support element are preferentially integrally formed. The hard component and the soft component are as defined above. In a first step the ring support and the support element are formed through injection moulding of the hard component. Thereafter, the ring support and the support element, which preferable form one piece, are turned around/upside down in the mould. Then the sealing element is formed on the hard component, i.e. on the ring support and on the support element, through injection moulding of the soft component. Between injection moulding of the hard component and injection moulding of the soft component sufficient cooling of the hard component, i.e. the ring support and the support element, is required and provided to ensure that there is no inseparable, thermal connection formed between the soft component and the hard component. For the hard component being polypropylene the mould release temperature is about 100 degrees Celsius, with an end temperature of about 50 degrees Celsius being preferably reached when the soft component is injection moulded.

As the one-way valve is entirely formed through injection moulding there are advantageously no mounting steps involved in its fabrication. For providing a tube head of a tube with a one-way valve according to the invention, the one-way valve is pressed into the neck of the tube head in the direction towards the port and assembled to the neck by force fitting such that the ring support is fitted to the inner surface of the neck. The one-way valve is held in the tube head by its ring support, which is radially arranged in the neck, and sealed towards the neck of the tube head. As the design of the one-way valve is rather compact, it requires little installation space leaving more space for e.g. the contents of the tube and it can be easily attached inside a tube head.

Once compression of the tube has ceased and the internal pressure in the tube container decreases, flow of ambient air into the container is advantageously prevented as the sealing element of the one-way valve again comes to rest on the ring support, thereby closing the at least one opening of the support member so that ambient air can not enter the container. Similarly, contents that have entered the port and/or a cannula during compression and that have hence already been in contact with ambient air are prevented from entering the container by the sealing element resting on the ring support.

Preventing ambient air and with ambient air contaminated contents, respectively, from being sucked into the tube container is especially important if the contents are likely to react with oxygen, i.e. are oxygen-sensitive. Furthermore, by preventing ambient air from being sucked into the container, the tube container is kept from taking its uncompressed shape thus making the fill level of the tube visible.

BRIEF DESCRIPTION OF THE DRAWINGS

Further advantageous features and applications of the invention can be found in the depending claims as well as in the following description of the drawings illustrating the invention. In the drawings like reference signs designate the same or similar parts throughout the several figures of which:

The dimensions in the Figures are given by way of example and without any limitation.

MODE(S) FOR CARRYING OUT THE INVENTION

Figure 1:
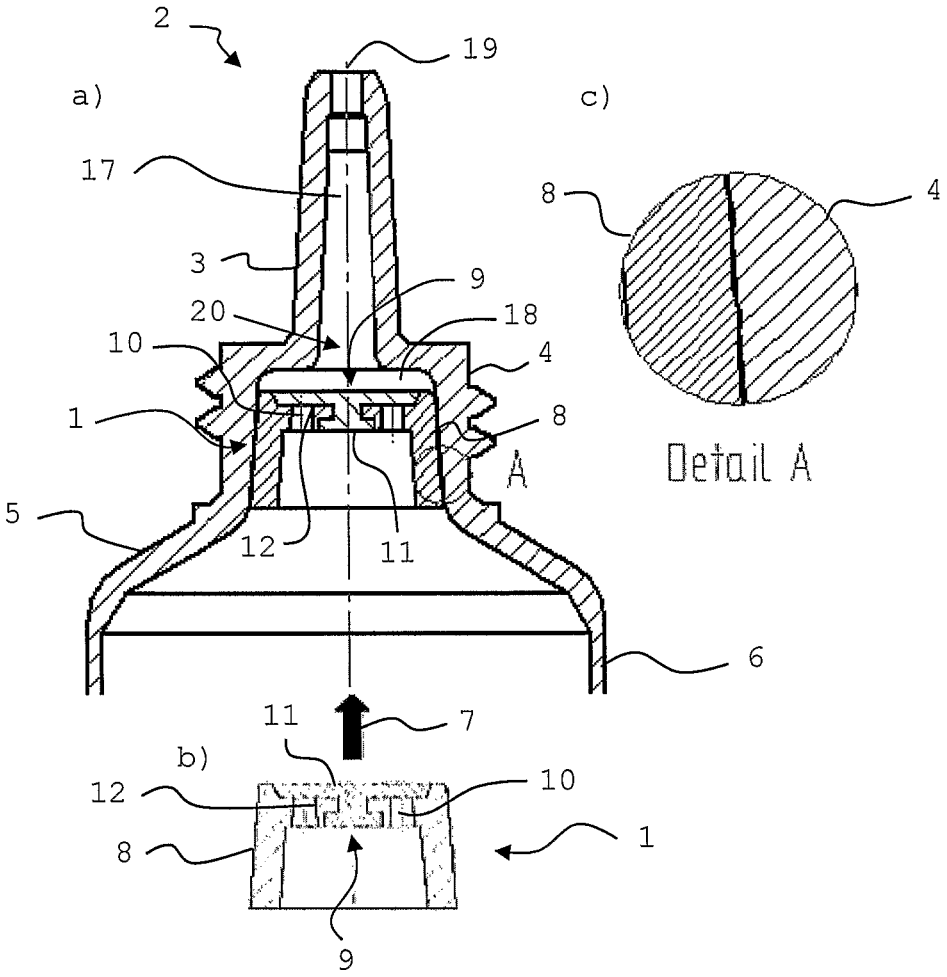
FIG. 1 depicts a sectional view of a tube head with a first embodiment of a one-way valve of the invention (FIG. 1*a*)), a sectional view of the first embodiment of a one-way valve of the invention (FIG. 1*b*)), and an enlarged detail of the sectional view of the tube head shown in FIG. 1*a*) (FIG. 1*c*))
Figure 2:
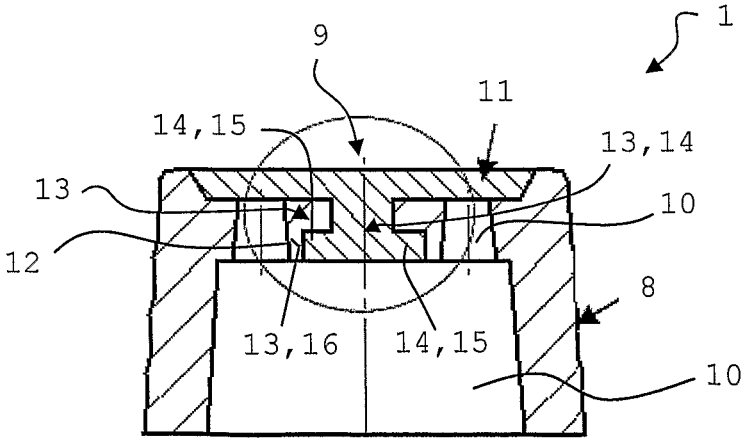
FIG. 2 depicts a further sectional view of the first embodiment of a one-way valve of the invention shown in FIG. 1*b*)
Figure 3:
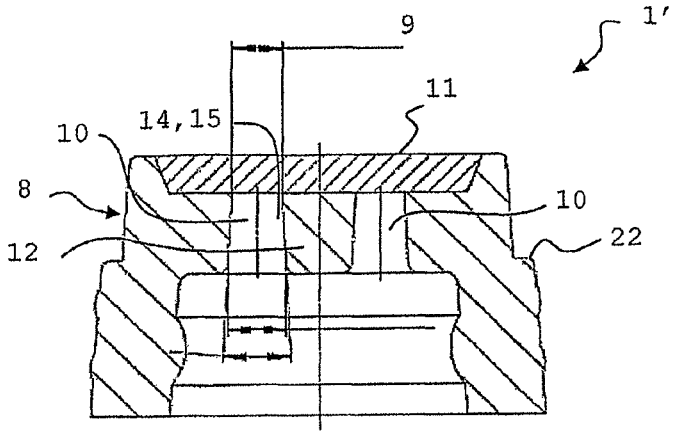
FIG. 3 depicts a sectional view of a second embodiment of a one-way valve of the invention, the sectional view running through the openings of the ring support along a plane that lies parallel and spaced apart from a plane in which the longitudinal axis of the one-way valve lies.

FIGS. 1 and 2 show a first embodiment 1 of a one-way valve according to the invention (FIGS. 1*b*) and 2) and a tube head 2 of a tube according to the invention (FIG. 1*a*)) into which the one-way valve 1 has been inserted. The tube head 2 comprises a port 20 that—in this particular embodiment of the tube head 2—extends into a cannula 3, a neck 4 and a shoulder 5, that is connected to the port 20 and hence the cannula 3 via the neck 4. The shoulder 5 connects to the container 6 of the tube of the invention. Of course, a tube head 2 without a cannula 3 can be provided. For insertion, the one-way valve 1 is moved into the tube head 2 in the direction indicated by the arrow 7, i.e. towards the port 20, and pressed into the neck 4 thereby forming a press fit with the neck 4. The neck 4 comprises a thread on its outside so that a cap can be screwed onto the tube head 2.

Figure 4:
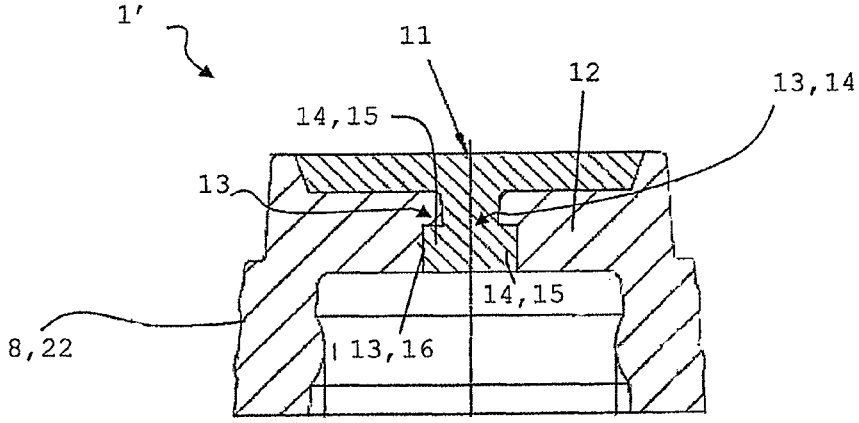
FIG. 4 depicts a sectional view of the second embodiment of a one-way valve of the invention, the sectional view running along a plane in which the longitudinal axis of the one-way valve lies and that lies parallel and spaced apart from the plane of the sectional view in FIG. 3.
Figure 5:
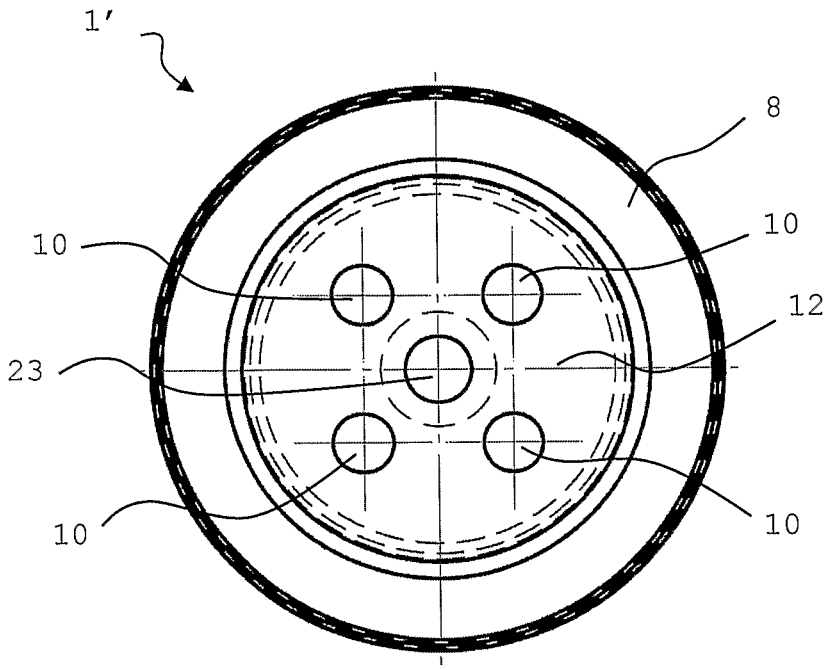
FIG. 5 depicts a plan view from below of the second embodiment of a one-way valve of the invention without sealing element.
Figure 6:
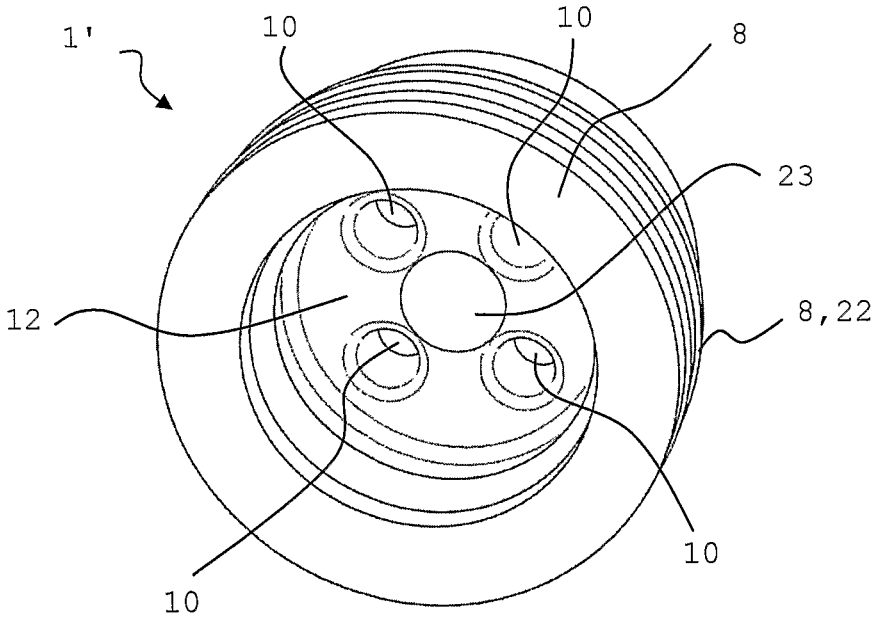
FIG. 6 depicts a perspective view of the second embodiment of a one-way valve of the invention without sealing element.

The one-way valve 1 comprises a ring support 8 and a sealing means 9 that is inserted in the ring support 8. The sealing means 9 comprises a sealing element 11 and a support element 12 to which the sealing element 11 is connected by anchoring means 13. The support element 12 has openings 10 and is connected with the ring support 8 (confer FIGS. 4 to 6). The anchoring means 13 are preferably formed by the sealing element 11 and the support element 12, in particular by the sealing element 11 having an anchor 14 with a preferentially radially extending disc 15 and by the support element 12 having a preferentially annular recess 16 in which the disc 15 is held such that the sealing element 11 can not be entirely lifted off the support element 12 in the direction towards the port 20 (see FIG. 2). The sealing element 11 is only anchored in the support element 12. There is no thermal connection between the sealing element 11 and the support element 12 and between the sealing element 11 and the ring support 8, respectively, so that the sealing element 11 can be lifted off the ring support 8 and the support element 12 to the extent to which it is not held by the anchoring means 13 on the support element 12. The sealing element 11 has preferably the shape of a disc extending in radial direction.

The sealing element 11 and the support element 12 with the openings 10 are preferably formed as described below for a second embodiment 1' of a one-way valve according to the invention.

The bending stiffness of the sealing element 11 is lower than the bending stiffness of the ring support 8 and of the support element 12. To achieve this, the sealing element 11 preferably consists of a soft component whereas the support element 12 and the ring support 8 consist of a hard component, with the soft component and the hard component not being thermally connected. For the definition of the soft component and the hard component it is referred to the introductory part of the description.

FIGS. 3 to 6 show a second embodiment 1' of a one-way valve of the invention. For ease of presentation the sealing element 11 is not shown in FIGS. 5 and 6. The support element 12 has exemplarily four openings 10 arranged coaxially around the longitudinal axis of the one-way valve 1' through which contents can pass from a tube container 6 to a port 20 of a tube head. There can be more or less than four openings 10 provided in the support means 12. In a closed state of the one-way valve 1' the openings 10 are covered by the sealing element 11. Reference sign 23 in FIGS. 5 and 6 designates where the anchor 14 is located in support element 12. The sealing element 11 and the support element 12 of the first embodiment 1 of a one-way valve of the invention shown in FIGS. 1 and 2 may be formed as shown in FIGS. 3 to 6.

The ring support 8 of the second embodiment 1' of the one-way valve of the invention depicted in FIGS. 3 to 6 and also 9 is provided with positioning means 22 on its outer surface for more accurate positioning of the one-way valve 1' on the inside of a neck 4 of a tube head. The positioning means 22 are preferably formed as outwardly projecting shoulder on the outer surface of the ring support 8.

When connecting the one-way valve 1, 1' with the neck 4 of the tube head 2 through press fitting, the radially arranged ring support 8 is sealingly connected to the inner surface of the neck 4 such that the one-way valve 1, 1' is held by the ring support 8 within the tube head 2 and sealed towards the inner surface of the neck 4. FIG. 1*c*) shows the sealing connection of the outer surface of the ring support 8 with the inner surface of the neck 4 in detail. The same applies to the second embodiment 2' of the tube head shown in FIG. 9 and described below.

The port 20 has in particular a smaller inner diameter than the bore of the neck 4. If the port 20 extends into a cannula with a bore 17, then the diameter of the bore 17 of the cannula 3 is in particular smaller than the bore of the neck 4. A head space 18 is provided between the one-way valve 1, 1' and the port 20 and the cannula 3, respectively, in that the ring support 8 of the one-way valve 1, 1' is fixed to the neck spaced apart (in the longitudinal direction) from the port 20 (and the cannula 3 and its bore 17, respectively, if provided). The head space 18 is located between the sealing element 11 and the port 20 and the distal end of the cannula 3, respectively. The distal end of the cannula 3 is that end of the cannula 3 that is further away from the outlet 19 of the cannula 3 and located closer to neck 4. That is, the one-way valve 1, 1' is only pressed so far into the neck 4 of the tube head 2, 2' that the head space 18 is formed (see FIG. 9 for the second embodiment 2' of a tube head). The head space 18 provides space for the sealing element 11 when it is lifted off the ring support 8 upon compression of the tube.

Figure 7:
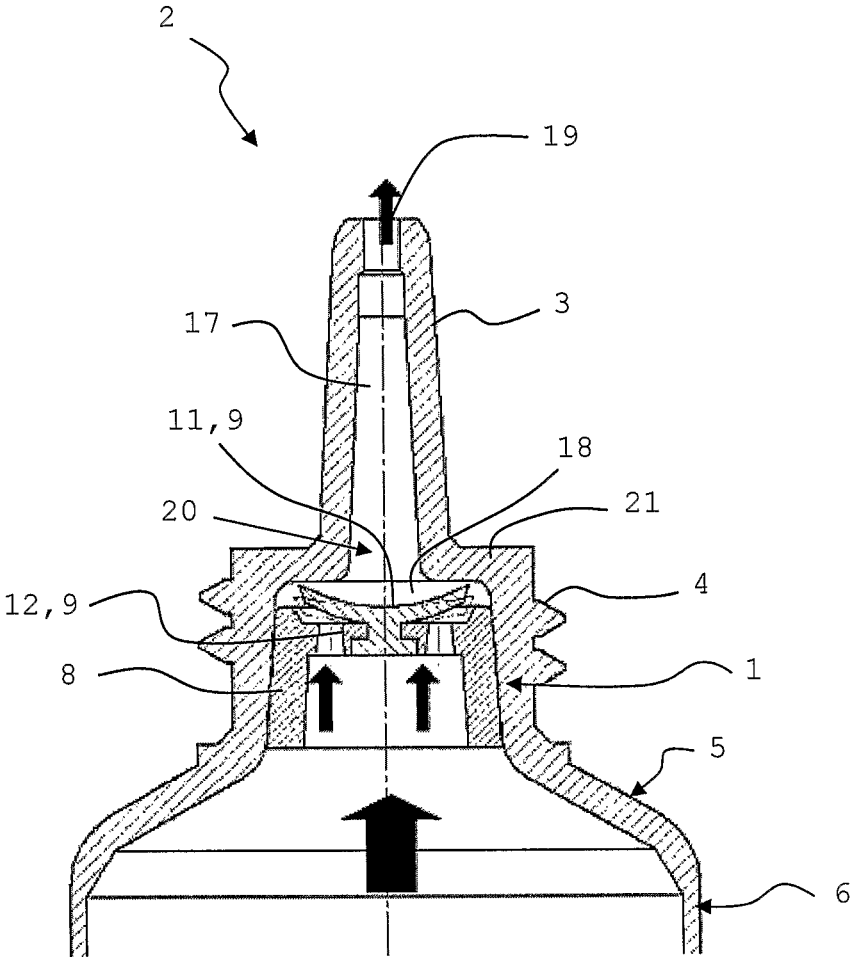
FIG. 7 depicts a sectional view of a tube head with the first embodiment of a one-way valve of the invention in open or opening state, respectively.

FIG. 7 shows the tube head 2 shown in FIG. 1*a*) with the tube and its container 6, respectively, being compressed to dispense contents through the port 20 and further through the bore 17 of the optional cannula 3. Being of lower stiffness than the ring support 8 and the support element 12 and preferably of a soft component, the sealing element 11 is lifted off the ring support 8 and partly off the support element 12 due to the inner pressure in the tube container 6 and uncovers thereby the openings 10 in the support element 12. The contents of the container 6 can now pass through the openings 10 of the support element 12 and further through the port 20, flow towards the outlet 19 of the cannula 3 and be dispensed. The black arrows in FIG. 7 indicate the direction of flow of the contents.

Figure 8:
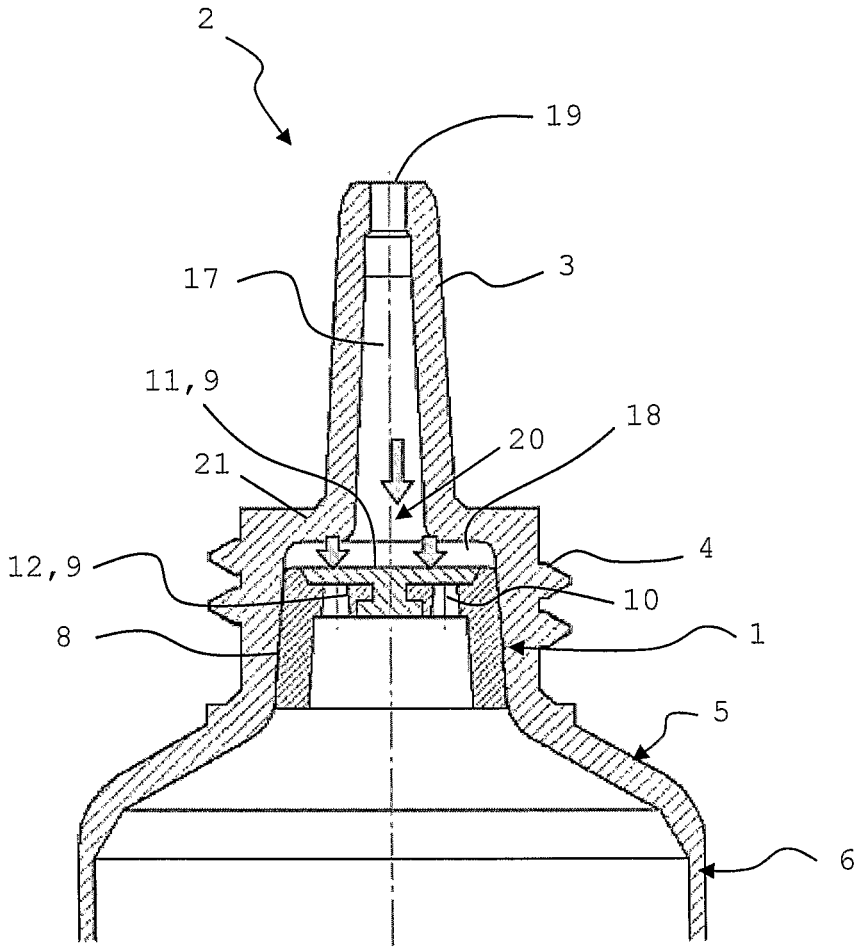
FIG. 8 depicts a sectional view of a tube head with the first embodiment of a one-way valve of the invention in closed state.

When the pressure onto the tube is taken back, the inner pressure in the container 6 collapses and the sealing element 11 falls back onto the ring support 8 and blocks the return flow of the contents through the openings 10 into the container 6 in addition to preventing that ambient air is sucked into the container 6. This is depicted in FIG. 8 where the arrows depict the direction of the return flow of the contents and the direction of flow of the ambient air. The tube head 2 shown in FIGS. 1*a*), 7 and 8 can of course also be provided with the second embodiment 1' of a one-way valve according to the invention shown in FIGS. 3 to 6.

Figure 9:
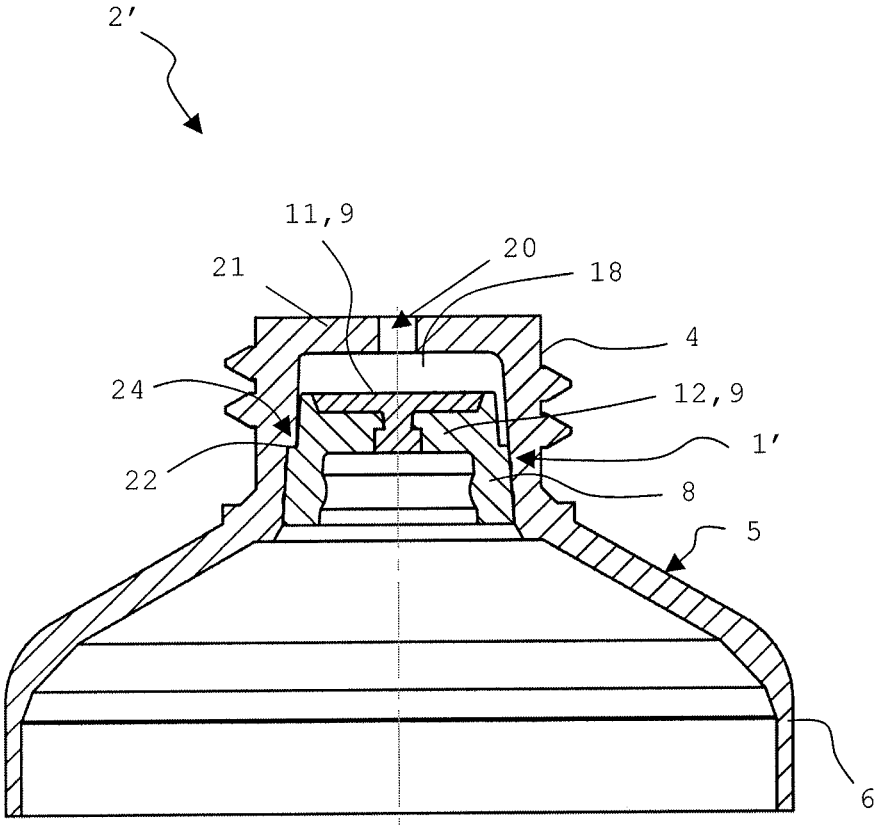
FIG. 9 depicts a sectional view of a further embodiment of a tube head with the second embodiment of a one-way valve of the invention in closed state.

FIG. 9 shows a second embodiment 2' of a tube head of a tube according to the invention, wherein the cannula 3 is dispensed with, i.e. the contents of the tube container 6 is directly dispensed from the port 20. The tube head 2' is provided with the second embodiment 1' of the one-way valve of the invention as depicted in FIGS. 3 to 6. The inner surface of the neck 4 is provided with a counterpart 24 to the positioning means 22 on the outer surface of the ring support 8 of the one-way valve 1'. With the positioning means 22 given by an outwardly projecting shoulder, its counterpart 24 on the inner surface of the neck 4 is preferably formed as inwardly projecting shoulder 24. The outwardly projecting shoulder 22 of the ring support 8 abuts against the inwardly projecting shoulder 24 when the one-way valve 1' is pressed into the neck 4, thereby facilitating positioning of the one-way valve 1' inside the neck 4 and forming of the head space 18, as the distance from the inwardly projecting shoulder 24 of the neck 4 to the port 20 in longitudinal direction in relation to the distance between the outwardly projecting shoulder 22 of the ring support 8 to the upper side of the sealing element 11 in longitudinal direction defines the height of the head space 18. Of course, the second embodiment 2' of the tube head can also be provided with the first embodiment 1 of the one-way valve according to the invention as depicted in FIGS. 1, 2, 7, 8 and 10.

Figure 10:
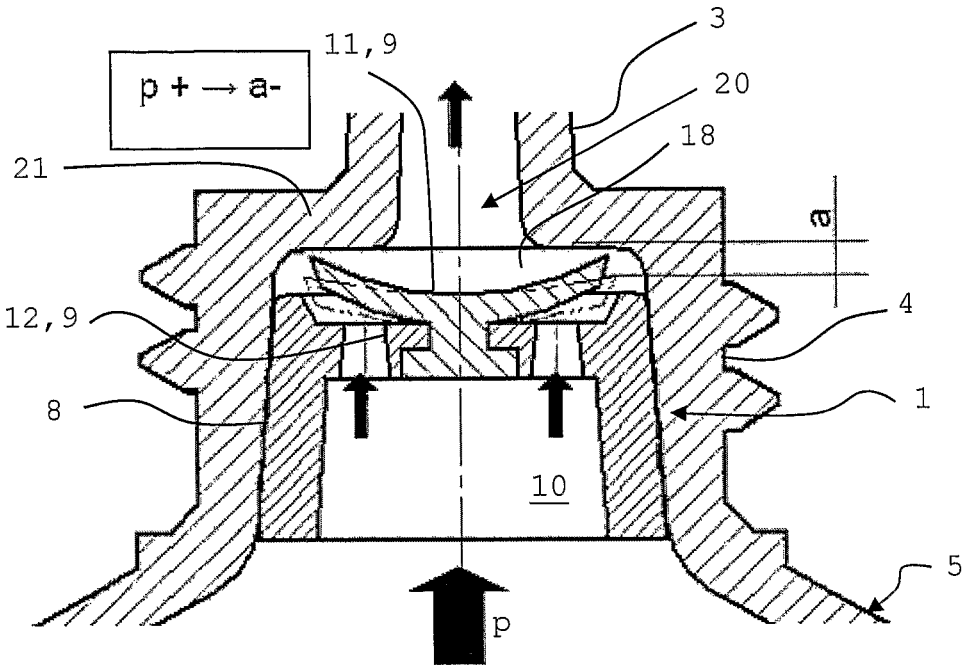
FIG. 10 depicts a sectional view of a tube head with the first embodiment of the one-way valve of the invention moving towards an open state in which it closes the entrance to the port.

The dispensed amount of fluid, in particular the dropping rate, i.e. the amount of drops dispensed during a certain time interval, is automatically adjusted in that the sealing element 11 of the one-way valve 1, while being lifted off the ring support 8 and partly off the support element 12 during application of the pressure 'p' to the container 6, moves sufficiently far into the head space 18 that the passage 'a' between the tube head 2, in particular its top wall 21, and the sealing element 11 is reduced/narrowed so that less contents can pass through the port 20 and the bore 17 of the optionally provided cannula 3. The larger the pressure 'p' is, the narrower the passage 'a' becomes. This is especially important for contents of low viscosity. The sealing element 11 has in particular the form of a disc that is bent towards the top wall 21 upon pressure application with its rim portion being lifted off the ring support 8 and partly off the support element 12. This is shown in FIG. 10 in detail with the arrows indicating the direction of the pressure 'p' and the direction of contents flow. If the internal pressure 'p' in the tube container 6 exceeds a certain limit, then the sealing element 11 is moved or bent, respectively, so far into the head space 18 that it abuts against the top wall 21 and thereby closes the entrance to the port 20 and, hence, to the bore 17 in the cannula 3 (if provided), thereby preventing that contents enters the port 20 and is dispensed. The top wall 21 represents the transition between from the neck 4 to the port 20. For the sealing element 11 being disc-shaped, its annular rim touches the inner surface of the top wall 21 if the pressure limit is exceeded, thereby preventing contents from entering the port 20 and the bore 17, the latter if a cannula 3 is provided. Thus regulation of the dispensed amount of contents can advantageously be achieved. In FIG. 10 the first embodiment 1 of a one-way valve according to the invention is depicted. Alternatively, the second embodiment 1' depicted in FIGS. 3 to 6 and 9 could have been used and shown.

It is to be understood that while certain embodiments of the present invention have been illustrated and described herein, it is not to be limited to the specific embodiments described and shown.

The invention claimed is:

1. A tube with a tube head, a container and a one-way valve comprising a sealing means and a ring support, with the sealing means being at least partially inserted in the ring support, wherein the sealing means comprises a sealing element and a support element with at least one opening, wherein the sealing element is connected to the support element by anchoring means and rests on the ring support in a closed state of the one-way valve thereby covering the at least one opening, wherein the sealing element is of lower bending stiffness than the support element and the ring support, wherein the sealing element of the sealing means is discoidal or has a discoidal part with its rim portion resting on the top end of the ring support in the closed state of the one-way valve, wherein the tube head comprises a port, a hollow neck and a shoulder, with the port being connected to the neck and the neck being connected to the container via the shoulder, wherein the one-way valve being inserted in the neck with the ring support of the one-way valve being sealingly fixed to the neck, wherein the sealing element and the ring support of the one-way valve are designed such that the sealing element rests on the ring support when the tube is not compressed and that the sealing element is lifted off the ring support and at least partly off the support element when the tube is compressed thereby enabling the one-way valve to be in an open state and wherein the ring support is fixed to the neck such that the sealing element is bent so far into the head space that it closes the entrance to the port when the tube is compressed and the internal pressure of the tube exceeds a certain limit.

2. The tube according to claim 1, wherein the ring support and the support element are integrally formed, in particular integrally moulded.

3. The tube according to claim 1, wherein the sealing element consists of a soft component and the support element and the ring support consist of a hard component.

4. The tube according to claim 1, wherein the ring support is provided with positioning means on its outer surface.

5. The tube according to claim 1, wherein as anchoring means the sealing means comprises an anchor and the support element comprises a recess for receiving the anchor or part of the anchor.

6. The tube according to claim 1, wherein the port has a smaller inner diameter than the bore of the neck and wherein the ring support of the one-way valve is fixed to the neck such that a head space is provided between the sealing element of the sealing means of the one-way valve and the port.

7. The tube according to claim 1, wherein the ring support of the one-way valve is fixed to the neck by force fitting.

* * * * *